United States Patent [19]

Urbanowicz

[11] Patent Number: 4,896,604

[45] Date of Patent: Jan. 30, 1990

[54] STAMP WITH REPLACEABLE DIE PLATE ATTACHED TO SUPPORT MEMBER BY AN ELASTOMERICALLY EXTENSIBLE CONNECTION

[76] Inventor: Walter Urbanowicz, 531 3rd Ave. East, Owen Sound, Ontario, Canada

[21] Appl. No.: 145,318

[22] Filed: Jan. 19, 1988

Related U.S. Application Data

[63] Continuation of Ser. No. 840,032, Mar. 17, 1986, abandoned.

[51] Int. Cl.[4] ..... B41K 1/02

[52] U.S. Cl. ..... 101/379; 101/406

[58] Field of Search ..... 101/333, 125, 327, 103, 101/109, 368, 369, 371, 372, 373, 379, 391, 405, 406

[56] References Cited

U.S. PATENT DOCUMENTS

| | | | |
|---|---|---|---|
| 466,398 | 1/1892 | Dutemple | 101/406 |
| 752,771 | 2/1904 | Hardy | 101/109 X |
| 1,071,626 | 8/1913 | Pannier | 101/376 |
| 1,243,289 | 10/1917 | Hall | 101/369 |
| 2,685,129 | 11/1949 | Myers | 101/375 |
| 2,771,031 | 2/1953 | Knapp | 101/415.1 |

*Primary Examiner*—Edgar S. Burr
*Assistant Examiner*—Moshe I. Cohen
*Attorney, Agent, or Firm*—Rogers, Bereskin & Parr

[57] ABSTRACT

A stamp is described which includes a die plate constructed in a number of clipped-together die plate sections, a rectangular die plate mounting member with a rigidly affixed handle, and elastomerically extensible retainers which releasably engage opposing side edges of the die plate and which normally draw the die plate into secure engagement with the mounting member. The die plate can be removed for replacement with another die plate, or for addition or substitution of die plate sections which conveniently alter the message otherwise printed by the die plate. The elastomeric extensibility of the retainers permits expansion of the die plate (or replacement with a larger die plate) without necessitating use of a larger or different mounting member. Also, when the die plate becomes substantially oversized relative the die plate mounting member, the elastomeric retainers permit the die plate mounting member to be rocked by means of the handle to distribute pressure more evenly over the back of the die plate to ensure that a proper image is received for example on a sheet of paper. The mounting member also includes holders for releasably securing the retainers to the mounting member, and so arranged that the mounting member can be oriented with either its lengthwise or widthwise axis along a given axis of the die plate.

7 Claims, 1 Drawing Sheet

STAMP WITH REPLACEABLE DIE PLATE ATTACHED TO SUPPORT MEMBER BY AN ELASTOMERICALLY EXTENSIBLE CONNECTION

This is a continuation of co-pending application Ser. No. 840,032, filed on Mar. 17, 1986, now abandoned.

FIELD OF THE INVENTION

The invention relates generally to stamps which have die plates intended to print indicia on sheet materials, and more particularly to handheld rubber stamps adapted to print indicia which can be selectively altered.

BACKGROUND OF THE INVENTION

Hand-held rubbers stamps are well known. The most common type involves a die plate which is rigidly fixed to a wooden backing member and handle and which is intended to print a single message or image. Stamps are also known which include a slotted die support member whose slots can be selectively filled with various elongate dies normally bearing alphanumeric indicia. Another common type of handheld stamp which permits alteration of a printed image involves an endless belt carrying dies and appropriately mounted so that different dies can be rotated to a print position. A common example of such a device is a date stamp.

All of these prior art hand-held stamps have a basic limitation that the image to be printed must fill less than a predetermined area. This limitation is due largely to the inherent dimensional limitations of the die support mechanism and the associated manner of die securement. There is consequently a very severe limitation on the extent to which the image to be printed can be modified without providing a different die holder or stamp.

Accordingly, it is an object of the invention to provide a stamp in which die plates of varying overall dimensions can be accommodated. It is also an object of the invention to provide in such a stamp a convenient way of expanding or altering the associated die plate.

BRIEF SUMMARY OF THE INVENTION

The invention provides a stamp including a die plate having a front face bearing dies, a rear face, and first and second, opposing side edge portions. The term "die plate" as used in this disclosure and the appended claims designates a rigid generally planar backing member to which dies have been fixed.

The stamp also includes a die plate mounting member which is distinct from the die plate and which is normally positioned against the rear face of the die plate in use. A handle is rigidly fixed to the die plate mounting member, and extends rearwardly therefrom. In use, the handle and die plate mounting member serve the usual purpose of applying pressure to the die plate to properly produce an image for example on sheet materials.

The die plate is secured to the mounting member by elastomeric retaining means which form elastomerically extensible connections between each of the opposing die plate side edge portions and the die plate mounting member. The elastomeric retaining means are releasably secured to the die plate thereby permitting removal of the die plate for installation of a new die plate or alternatively for alteration and re-installation of a die plate in a manner described more fully below. The elastomeric retaining means are in tension during use and are so positioned relative to the die plate side edge portions and the mounting member that the tension normally keeps the die plate in contact with the support member. The term "elastomerically extensible connection" as used in this disclosure and the appended claims is intended to designate a connection made by means of elastomeric material which permits joined members to be momentarily separated by elastic extension of the material.

The advantages of the construction described above will become more apparent with the description of the preferred embodiment. However, the advantages may be briefly summarized as permitting extension of the elastomeric connections to accommodate various die plate sizes, and also to permit, with die plates that are oversized relative to the die plate mounting member, the ability to rock the mounting member relative to the die plate, when the latter is pressed against sheet material, to distribute pressure over the various surface areas of the die plate thereby ensuring production of a proper image. The latter advantage is particularly important if the die plate is to be constructed in a plurality of clipped-together die plate sections as described below.

DESCRIPTION OF THE DRAWINGS

The invention will be better understood with reference to drawings illustrating a preferred embodiment, in which.

DESCRIPTION OF PREFERRED EMBODIMENT

Figure 1:
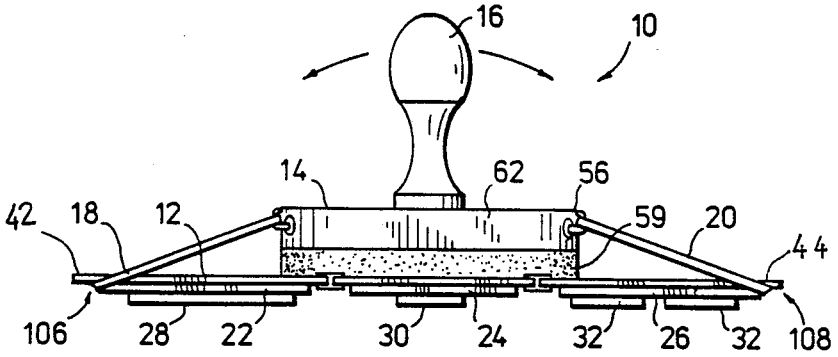
FIG. 1 is a side elevational view of a stamp.
Figure 2:
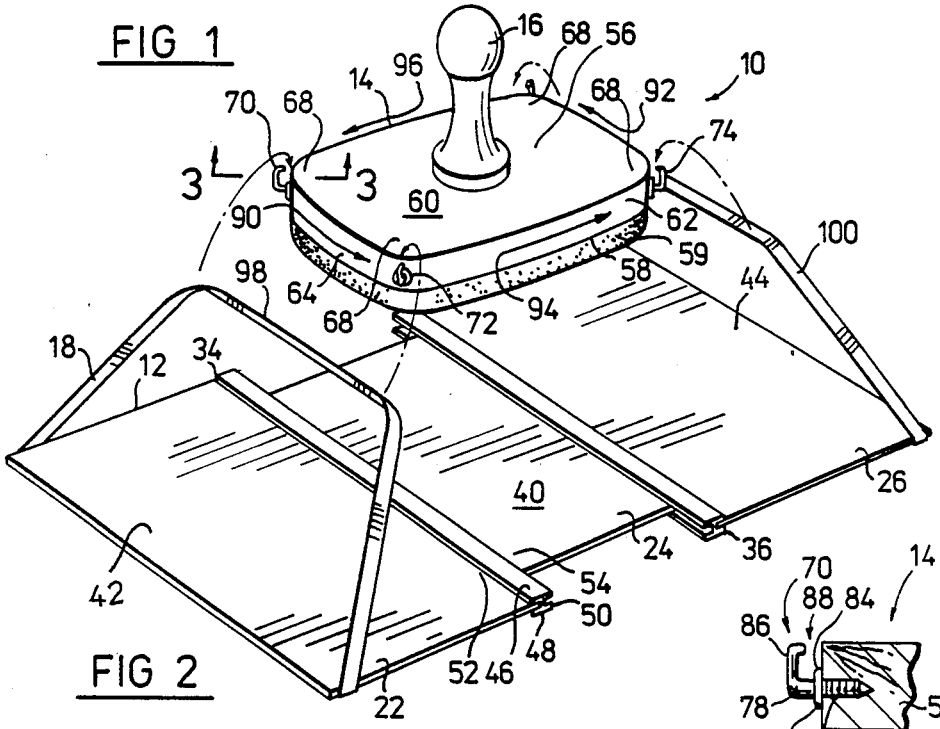
FIG. 2 is a perspective view of the stamp partially exploded.

FIGS. 1–4 illustrate a stamp 10 which is a preferred embodiment of the invention. The stamp 10 includes a die plate 12, a mounting member 14, and a handle 16 rigidly fixed to the mounting member 14. A pair of endless elastomeric belts 18, 20 form elastically extensible connections securing the die plate 12 to the backing member 14.

The die plate 12 is constructed in three generally coplanar die plate sections 22, 24, 26 bearing dies 28, 30, 32, respectively. The die plate sections are joined to one another by a pair of elongate H-shaped plastic clips 34, 36 to form a single die plate having a front surface 38 bearing dies, a rear surface 40 and a pair of opposing side edge portions 42, 44. From the views of FIGS. 1–3 it will be apparent that the H-shaped clip 34 has a pair of generally parallel arms 46, 48 joined by a transverse crossbar 50. The clip 34 spans the adjacent side edge portions 52, 54 of die plate sections 22, 24, front and rear surfaces (not indicated) of the side edge portion 52 being gripped between the clip arms 46, 48 to one side of the crossbar 50, and front and rear surfaces of the side edge portion 44 being gripped between the clip arms 46, 48 to the other side of the crossbar 50. The die plate sections 24, 26 are similarly gripped by the clip 36, and each of the clips 34, 36 is sufficiently resilient that the die plate sections can be removed and re-inserted into the clips as desired.

The die plate mounting member 14 includes a wood backing member 56 of elongate, generally rectangular shape. The front face 58 of the backing member is covered by a sponge-rubber cushioning material 59 adhesively secured to the backing member 56, which in use assists in more evenly distributing pressure over the rear surface 40 of the die plate during printing of an image. The handle 16 is squeeze-fit into an opening (not illustrated) in the rear face 60 of the backing member 56, in a conventional manner, and extends rearwardly from the mounting member 14.

The backing member 56 has an elongate, generally rectangular circumferential side edge 62 which in use is oriented generally transverse to the rear surface 40 of the die plate 12. The side edge 62 consists of four side edge sections (only side edge sections 64, 66 being visible in FIGS. 1 and 2) which meet to define four rounded corners 68. Four identical belt retainers 70, 72, 74, 76 are located one at each of the corners 68.

Figure 3:
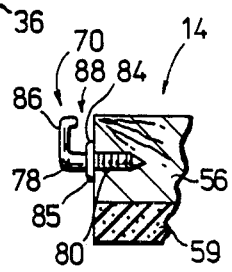
FIG. 3 is a cross-sectional view along the lines 3—3 of FIG. 2, fragmented, illustrating an elastomeric belt retainer; and, FIG. 4 is a perspective view from below of the stamp better illustrating the front surface of an associated die plate.
Figure 4:
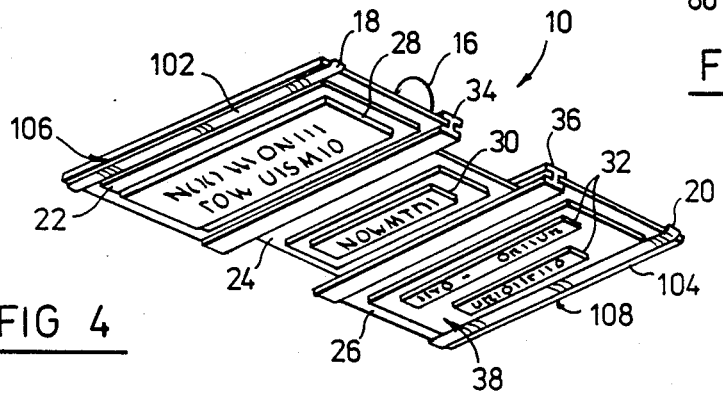

The construction and attachment of the belt retainer 70 is illustrated in the cross-sectional, fragmented view of FIG. 3. The belt retainer 70 has a generally C-shaped section with a first arcuate end portion 78 which terminates in a stud 80 that is squeeze-fit into a hole 82 drilled into the backing member 56. A circumferential shoulder 84 of circular transverse cross-section ensures that the stud 80 is introduced only to a predetermined distance into the interior of the backing member 56. A second circumferential shoulder 85 of generally rectangular transverse cross-section is considerably narrower than the shoulder 84, and penetrates the wood of the backing member 56 during installation to prevent undesired rotation of the belt retainer 70 about the stud 80. A second arcuate end portion 86 is located rearwardly from the first end portion 78, and is spaced from the mounting member 14 to define an opening 88 accessing the interior of the C-shaped section to permit receipt and removal of the endless belts 18, 20.

The arrangement of the belt retainers is significant. Using the belt retainer 72 as an example, it will be apparent that the belt retainer 72 is generally oriented at an angle of about 45 degrees to each of the adjacent side edge sections 64, 66 defining the associated corner into which the belt retainer 72 has been fitted. Each of the remaining belt retainers is similarly oriented with respect to the adjacent side edge sections defining its associated corner. As a result, the belt retainers together with the four side edge sections of the backing member 56 define a first pair of generally parallel belt location paths at 90, 92, and a second pair of generally parallel belt location paths 94, 96 transverse to the first pair 90, 92. This will be explained more fully below.

The die plate 12 is secured to the mounting member 14 basically as follows. A run 98 of belt 18 is slipped into belt retainers 70, 72, aligned along the belt location path 90. A run 100 of belt 20 is similarly slipped into belt retainers 74, 76 in alignment with belt location path 20. Belt 18 is then elastomerically stretched to locate the die plate side edge portion 42 within the belt (as in FIGS. 1 and 2) with a run 102, circumferentially spaced from the run 98, extending across and elastically gripping the front surface of the die plate side edge portion 42. In a similar manner, the die plate side edge portion 44 is located within the belt 20 with the run 104, circumferentially-spaced from the run 100, extending across and elastically gripping the front surface of the die plate side edge portion 54. To assist in proper location of the runs 102, 104, the opposing die plate side edge portions 42, 44 are recessed rearwardly at 106, 108 respectively. Each of the die plate sections 22, 24, 26 is in fact continuously recessed about its periphery at its front surface so that clips such as clips 34, 36 are recessed from front most die surfaces and so that the belt runs 102, 104 are properly located regardless whether the die plate sections are interchanged. The recessing, although preferred, is not absolutely necessary.

Once the die plate 12 has been secured to the mounting member 14 as described in the preceding paragraph, the die plate 14 is ready to be inked and applied to sheet materials. With the stamp 10 in the orientation of FIG. 1, inked and resting on sheet materials, the mounting member 14 may be rocked by means of the handle 16 in directions indicated in FIG. 1 to distribute pressure over the various dies 28, 30, 32.

The elastomeric belts 18, 20 could alternatively be located in belt location paths 94, 96 when a die plate is attached to the mounting member 14. In such circumstances, the width of the mounting member 14 rather than its length, may be located along he lengthwise axis of the new die plate. This would be particularly advantageous if the new die plate were of considerably smaller dimension than the die plate 12, perhaps having a length shorter than the length of the mounting member 14.

One of the advantages accruing with the construction and use of the stamp 10 is that the die plate 12 can be very readily modified. For example, in advertising special sales at a supermarket, standard form displays noting a special price might be posted adjacent products. By providing a multiplicity of die plate sections bearing standard terms associated with such sales, a composite die plate can quickly be constructed for stamping all required information onto standard display materials. Although not specifically illustrated, the die plate sections in such applications might normally be imprinted on rear surfaces thereof with the material to be printed by the particular die plate section and some indicator regarding the required orientation of the die plate section to produce a particular orientation of the printed materials. The elastomerically extensible connections characteristic of the stamp 10 will normally accommodate considerable variation in the size of the resultant die plate (within practical limits) without necessitating replacement of the endless belts 18, 20 and mounting member 14. Also, for considerably oversized die plates, the belts 18, 20 can be replaced with larger belts, without necessarily requiring replacment of the mounting member 14. Accordingly, a wide variety of messages can be printed with considerable variation in message size, with a limited amount of stamping hardware.

It will be appreciated that a particular embodiment of the invention has been described, and that modifications may be made therein without departing from the spirit of the invention or the scope of the appended claims. In particular, the endless elastomeric belts could be replaced with elastomeric straps, each having one end secured to the mounting member 14 in any convenient manner, and the other end terminating in an elongate C-shaped clip for receiving and gripping the opposing die plate side edge portions 42, 44. Also, the belt retaining means of the mounting member 14 which have been illustrated as four hooked retainers, can be replaced with four undercut channels formed in the rear face 60 of the backing member 56. These channels could for example be arranged in a rectangular layout with the channels intersecting at corners of the rectangular layout and opening at side edges of the backing member 56 to permit introduction of runs of the endless belts. Also, if hooked belt retainers are to be used, such as those illustrated, the C-shaped section of each belt retainer can be dimensioned so that the opening which receives a run of the endless belt, such as the opening 88, is normally smaller than the thickness of the endless belts when untensed, but permits clearance of the endless belts when the latter are extended under tension. In this manner, the belts can be more positively retained in the C-shaped sections when, for example, a die plate is removed from the stamp and there is consequently no tension on the endless belts. Other modifications will be apparent to those skilled in the art.

THE EMBODIMENTS OF THE INVENTION IN WHICH AN EXCLUSIVE PROPERTY OR PRIVILEGE IS CLAIMED ARE DEFINED AS FOLLOWS:

1. A stamp comprising:

a rigid planar die plate having a front face bearings dies, a rear face, and first and second opposing side edge portions;

a die plate mounting member distinct from the die plate and positioned against the rear face of the die plate;

a handle rigidly fixed to and extending rearwardly from the die plate mounting member;

first elastomeric retaining means for forming an elastomerically extensible connection between the first die plate side edge portion and the die plate mounting member, the first elastomeric retaining means including first releasable securing means for releasably securing the first elastomeric retaining means to the first die plate side edge portion;

second elastomeric retaining means for forming an elastomerically extensible connection between the second die plate side edge portion and the die plate mounting member, the second elastomeric retaining means including second releasable securing means for releasably securing the second elastomeric retaining means to the second die plate side edge portion;

the first and second elastomeric retaining means being in tension and so positioned relative to the die plate side edge portions and the die plate mounting member that the tension normally keeps the die plate in contact with the die plate mounting member and that the die plate mounting member can be rocked relative to the rear face of the die plate by means of the handle to apply pressure to different portions of the rear face of the die plate, the die plate being maintained in contact with the die plate mounting member solely by the first and second elastomeric retaining means.

2. A stamp as claimed in claim 1 in which:

the die plate includes first and second generally coplanar die plate sections, the first die plate section having a first side edge portion, the second die plate section having a second side edge portion, the first and second side edge portions of the die plates sections being located adjacent to one another;

the stamp includes removable clip means spanning the adjacent side edge portions of the die plate sections for joining the die plate sections.

3. A stamp as claimed in claim 2 in which the clip means comprise an elongate clip of generally H-shaped transverse cross-section having a pair of generally parallel arms joined by a transverse crossbar, front and rear surfaces of the first side edge portion of the first die plate section being gripped between the pair of arms to one side of the crossbar, front and rear surfaces of the second side edge portion of the second die plate section being gripped between the pair of arms to the other side of the crossbar.

4. A stamp as claimed in claim 1 in which:

the first retaining means comprise a first endless elastomeric belt, the first die plate side edge portion being located inside the first endless belt;

the second retaining means comprise a second endless elastomeric belt, the second die plate side edge portion being located inside the second endless belt;

the first releasable securing means comprise a first run of the first endless belt extending across and elastically gripping a front surface of the first die plate side edge portion; and, the second releasable securing means comprise a first run of the second endless belt extending across and elastically gripping a front surface of the second die plate side edge portion.

5. A stamp as claimed in claim 4 in which the die plate support member includes means for releasably retaining a second run of the first endless belt and a second run of the second endless belt.

6. A stamp as claimed in claim 5 in which the belt retaining means include means defining a first pair of generally parallel belt location paths and a second pair of generally parallel belt location paths transverse to the first pair of belt location paths, and access means for permitting the second runs of the first and second endless belts to be located along either the first pair of location paths or the second pair of location paths.

7. A stamp as claimed in claim 6 in which:

the die plate mounting member has an elongate, generally rectangular circumferential side edge oriented generally transverse to the rear face of the die plate and having four side edge sections meeting to define four corners;

the belt retaining means comprise four belt retainers, one of the four belt retainers being located at each of the four corners;

each of the belt retainers has a generally C-shaped section with a first arcuate end portion fixed to the die plate mounting member at the corner at which the belt retainer is located and a second arcuate end portion located rearwardly of the first end portion and spaced from the die plate mounting member thereby defining an opening accessing the interior of the C-shaped section;

each of the belt retainers is oriented generally at an angle of about 45 degrees to the adjacent side edge sections defining the corner at which the belt retainer is located.

* * * * *